United States Patent [19]

Ford et al.

[11] 4,438,798

[45] Mar. 27, 1984

[54] MASTER CARRIER FOR A TRAVERSE ROD

[75] Inventors: James A. Ford; Steven R. Haarer, both of Sherman Township, St. Joseph County, Mich.

[73] Assignee: Cooper Industries, Inc., Houston, Tex.

[21] Appl. No.: 298,553

[22] Filed: Sep. 2, 1981

[51] Int. Cl.[3] ..... A47H 1/00

[52] U.S. Cl. ..... 160/126

[58] Field of Search ..... 160/126, 172, 176, 345, 160/346; 16/87.2, 87.4 R, 87.6 R, 87.8, 94 D, 95 D, 96 D

[56] References Cited

U.S. PATENT DOCUMENTS

| | | | |
|---|---|---|---|
| Re. 26,269 | 9/1967 | Ford | 160/346 |
| 3,140,169 | 2/1979 | Arena | 160/178 |
| 3,273,197 | 9/1966 | Ford | 16/94 |
| 3,299,943 | 1/1967 | Poe | 160/176 |
| 3,503,434 | 3/1970 | Ford | 160/345 |
| 3,693,696 | 9/1972 | Salzmann | 160/345 |
| 3,881,219 | 5/1975 | Haarer | 16/94 |
| 3,951,196 | 4/1976 | Salzmann | 160/345 |
| 3,951,197 | 4/1976 | Cohen et al. | 160/346 |
| 3,996,988 | 12/1976 | de Wit | 160/168 |

*Primary Examiner*—Peter M. Caun

*Attorney, Agent, or Firm*—Flynn, Thiel, Boutell & Tanis

[57] ABSTRACT

A master carrier is structured for lengthwise sliding support on a single drapery rod having two integral, side-by-side and parallel channels, each of the channels having a lengthwise extending slot therein with one of the slots opening downwardly and with cordage being housed in the other channel for operation of the master carrier. The master carrier is composed of at least two parts, one part being slidably supported in the channel housing the cordage and the other being slidably supported in the other channel. Fastening elements are utilized for securing the two parts together. A passageway is provided through that part of the master carrier associated with the cordage so that the cordage can be engaged and adjusted externally of the drapery rod.

14 Claims, 9 Drawing Figures

MASTER CARRIER FOR A TRAVERSE ROD

CROSS REFERENCE FOR RELATED APPLICATIONS

This application is related to copending applications filed concurrently herewith, Ser. Nos. 298,554 and 298,552.

FIELD OF THE INVENTION

This invention relates to a master carrier for a traverse rod and, more particularly, to a two-piece master carrier wherein one piece is to be coupled to the traversing cordage while slidably disposed on the traverse rod and the other piece is to be coupled to a selected drapery material or vertical blind hanger, both pieces thereafter being secured together to simultaneously slidably support same and a selected hanger for movement along the traverse rod.

BACKGROUND OF THE INVENTION

The invention disclosed herein arose out of a need to provide an inconspicuous traverse rod assembly for use in a vertical blind arrangement. Most traverse rods are conspicuously supported across the top of a window opening. Usually an attempt is made by the installer to select a color of the rod which will match the decor of the area. However, it has been and still is unlikely that a perfect color matching will be possible. Further, the problem of color matching becomes enhanced when the decor of the area is changed. Oftentimes, a painter will accidently deposit paint on the traverse rod and not timely remove same, thereby causing the paint to be unsightly and requiring it be hidden by a valance or other form of drapery treatment.

The problem of conspicuousness with respect to the traverse rod as such and the internal structure operable therewith to effect an operation of the vertical blinds has been solved by the structure disclosed in copending applications filed concurrently herewith, Ser. Nos. 298,554 and 298,552. This structure satisfactorily separates the operation of the vertical blinds about a vertical axis and the cords for moving the vertical blinds across the window opening and thereby prevents the cordage from becoming ensnarled in the drive mechanism for moving the vertical blinds about a vertical axis. However, the problem of developing a satisfactorily operable master carrier cooperable with the traverse rod, the end structure therefor and the cordage for effecting a movement thereof has remained a problem.

It has been particularly troublesome to effect a proper securement of the cordage to the master carrier in traverse rod assemblies which are of a construction enabling it to be inconspicuous when installed. Accordingly, it is desirous to solve the problem of providing a satisfactorily operable master carrier for the traverse rod which remains interference-free of the structure effecting a movement of the vertical blinds about a vertical axis.

The objects of the invention include:

1. To provide a master carrier which is easily assembled on a traverse rod and easily connected to the cordage for operating same and to a selected hanger supporting the leading edge of drapery material or a vertical blind utilized with the traverse rod.

2. To provide a master carrier, as aforesaid, which is comprised of at least two components which can be separately handled and connected to the various components of the traverse rod assembly by using conventional tools.

3. To provide a master carrier, as aforesaid, which is of a durable construction and is easily maintainable.

4. To provide a master carrier, as aforesaid, wherein one piece of the multiple component master carrier is slidably disposed on the traverse rod at the time the cordage is connected thereto and wherein the other piece is selectively coupled to a hanger slidably disposed on a separate portion of the traverse rod so that when the two pieces of the master carrier are connected together, the associated hanger will be caused to move with the master carrier.

5. To provide a master carrier, as aforesaid, having fastening means thereon to enable the positioning of the piece connected to the hanger at an appropriate location so that when the drapery material or vertical blinds are in a closed position in front of the window, there will be no gap between the mutually adjacent edges of the drapery material or vertical blind material.

6. To provide a master carrier, as aforesaid, wherein the left-hand and right-hand master carriers are composed of identical parts.

SUMMARY OF THE INVENTION

In general, the objects and purposes of the invention are met by providing a master carrier for use on a single drapery rod having two integral, side-by-side and parallel channels, each of the channels having a lengthwise extending slot therein with one of the slots opening downwardly and with cordage being housed in the other channel for operation of the master carrier. The master carrier is composed of at least two parts, one part being slidably supported in the channel housing the cordage and the other being slidably supported in the other channel. Fastening elements are utilized for securing the two parts together. A passageway is provided through that part of the master carrier associated with the cordage so that the cordage can be engaged and adjusted externally of the drapery rod.

BRIEF DESCRIPTION OF THE DRAWINGS

Other objects and purposes of this invention will be apparent to persons acquainted with apparatus of this general type upon reading the following specification and inspecting the accompanying drawings, in which.

DETAILED DESCRIPTION

Figure 1:
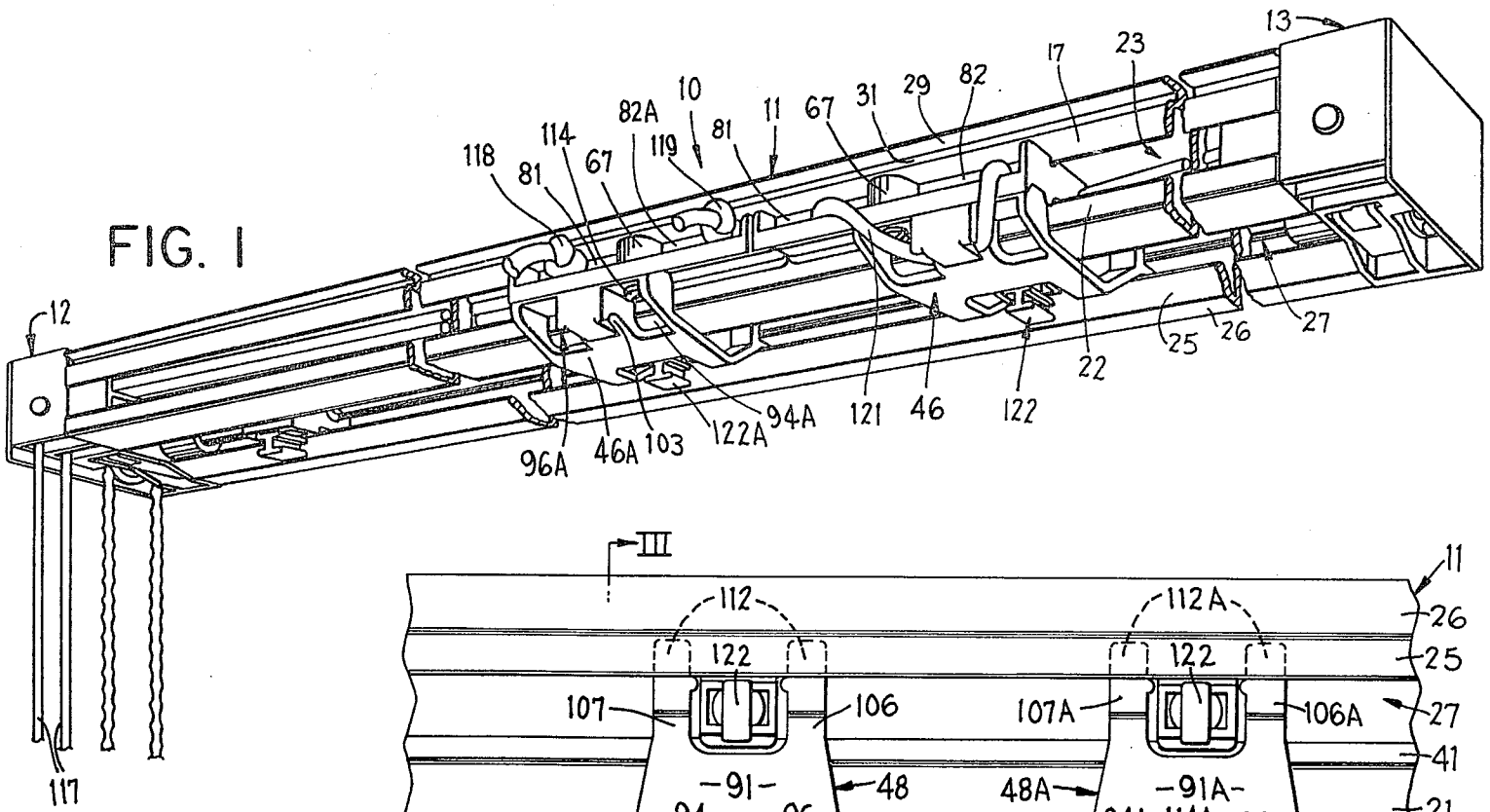
FIG. 1 is a rear perspective view of a traverse rod having master carrier members embodying the invention thereon.

The words "up", "down", "right" and "left" will designate directions in the drawings to which reference is made. The words "front" and "rear" will also designate directions in the drawings to which reference is made, the "front" side of the master carrier and traverse rod in FIG. 3 being the right side thereof. The words "in", "out" and derivatives thereof will refer to directions toward and away from the geometric center of the device and designated parts thereof.

The preferred traverse rod assembly 10 illustrated in FIG. 1 includes an elongated traverse rod 11 and a pair of end structures 12 and 13 on opposite ends thereof. The features of the end structures 12 and 13, the details of the traverse rod and the cooperation of the master carrier and sliders with each other and with other structure on the traverse rod are the subject matter of the aforementioned copending applications filed concurrently herewith. The first such copending application is entitled END STRUCTURE FOR A TRAVERSE ROD, Ser. No. 298,554 and the second application is entitled TRAVERSE ROD FOR A VERTICAL BLIND, Ser. No. 298,552. The disclosures in these two applications are incorporated by reference herein.

Figure 3:
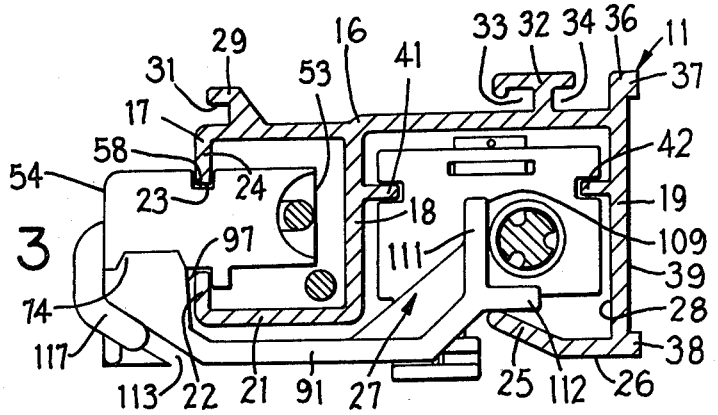
FIG. 3 is a sectional view taken along the line III—III of FIG. 2.

For purposes of convenience, however, a brief description will be given with respect to the traverse rod 11. As shown in FIG. 3, the traverse rod 11 has a top wall 16 and downwardly extending and transversely spaced rear wall 17, middle wall 18 and front 19. A substantially horizontal bottom wall 21 is integrally connected to the middle wall 18 at the bottom thereof and terminates in an upwardly extending rear flange 22 coplanar with the rear wall 17. The upper edge of the rear flange 22 and the lower edge of the rear wall 17 are spaced vertically from one another to define an opening 23 into a channel 24 defined by the top wall 16, the walls 17, 18, 21 and flange 22. A substantially horizontal flange 26 is integrally connected to the front wall 19 at the bottom edge thereof and extends rearwardly and upwardly, toward but terminates short of the middle wall 18 to define an opening 27 into a channel 28 defined by the flange 26, the front wall 19, the top wall 16 and the middle wall 18. The rear edge portion 25 of the flange 26 is inclined upwardly.

The top wall 16 has plural upstanding ribs thereon. The rib 29 extends upwardly adjacent the plane containing the rear wall 17 and has a rearwardly opening recess 31 therein. The rib 32 extends upwardly fron the top wall intermediate the plane containing the middle wall 18 and the front wall 19 and has a rearwardly opening recess 33 and a further frontwardly opening recess 34. The rib 36 extends upwardly in generally the same plane as the front wall 19 and has a lengthwise bead 37 extending forwardly of the plane containing the front wall 19. Similarly, a small bead 38 extends forwardly of the front wall 19 but in the plane of the bottom wall 26. The beads 37 and 38 define a shallow trough 39.

A pair of inwardly projecting and coplanar flanges 41 and 42 are provided on the walls 18 and 19, respectively, in the channel 28 approximately one-third of the way down from the top wall 16.

A conventional type of wall mounted bracket (not shown) can be used to mount the traverse rod 11 to a upstanding wall. Similarly, a related bracket (not illustrated) can be utilized for mounting the traverse rod to the ceiling. Both types of brackets are generally illustrated in U.S. Pat. No. 3,273,197 and reference thereto is incorporated herein.

Each traverse rod 11 has at least one master carrier 46 thereon, especially if the traverse rod is sufficiently short and it is intended to move the drapery material or vertical blind members toward and away from one side only of the window opening. If the window opening is sufficiently large to justify two panels of drapery material or vertical blinds movable toward and away from an intermediate zone of the window opening, the traverse rod would then be equipped with two master carriers, such as the master carriers 46 and 46A illustrated in FIGS. 1 and 2. The master carriers 46 and 46A are composed of identical parts, namely, a master carrier slide 47 and a master carrier bridge 48 as most clearly shown in FIG. 4. Thus, the two master carriers 46 and 46A will be described utilizing common reference numerals.

Figure 7:
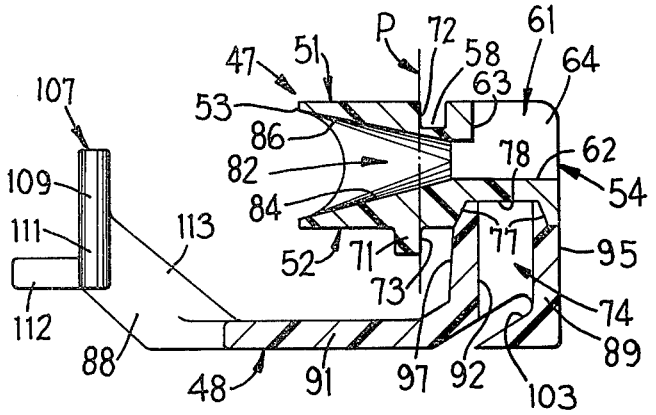
FIG. 7 is a sectional view taken along the line VII—VII of FIG. 5.

The master carrier slide 47 has a body 49 made of a thermoplastic material having a top wall 51, a bottom wall 52, a front side wall 53, a rear side wall 54 and end walls 56 and 57. The top wall 51 has an upwardly opening slot 58 of uniform width and depth extending between the end walls 56 and 57. In this particular embodiment, the slot 58 has an upstanding front side 72 extending in a vertical plane P (FIG. 7). The slot 58 also opens outwardly at the end walls 56 and 57 as illustrated at 59 in FIG. 4. A recess 61 is provided in the top wall 51 and opens upwardly and rearwardly of the rear side wall 54 as shown in FIG. 7. The recess 61 extends across the full width of the body 49 and has a bottom wall 62, offset below the plane of the top wall 51, and upstanding side walls 63, 64 and 65. An embossment 67, which is provided in the recess 61 at a central location therein, is integrally formed with the bottom wall 62 and the upstanding wall 63. The embossment 67 has a rearwardly facing cylindrical surface 68. A vertical hole 69 is provided in the embossment 67 and opens through both the top wall 51 and the bottom wall 52. The upper surface of the embossment 67 is flush with the top wall 51.

The bottom wall 52 of the master carrier slide 47 has an elongated rib 71 projecting downwardly therefrom and extending the full width of the body 49. The rib 71 has a rear side 73 which is coplanar with the plane P as shown in FIG. 7. The significance of this construction is discussed below.

Figure 4:
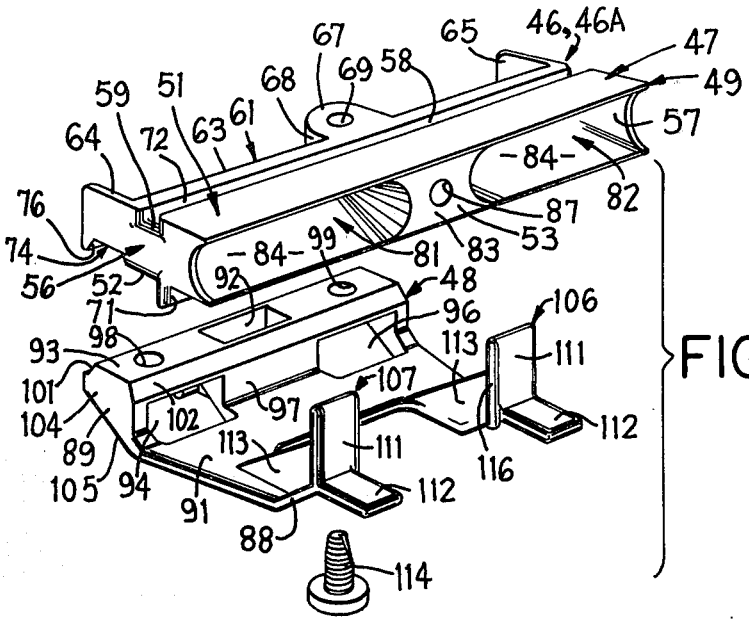
FIG. 4 is an exploded perspective view of the master carrier embodying the invention.
Figure 5:
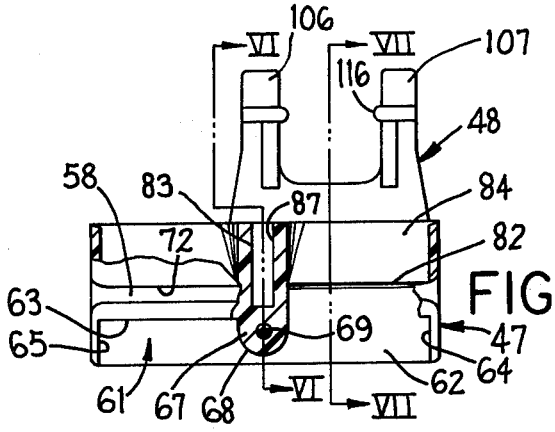
FIG. 5 is a top view, partially sectioned, of said master carrier.
Figure 6:
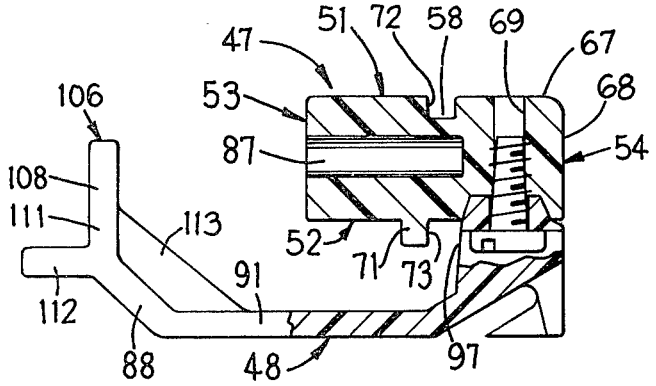
FIG. 6 is a sectional view taken along the line VI—VI of FIG. 5.

The bottom wall 52 also has an elongated groove 74 which extends through the end walls 56 and 57, as at 76 in FIG. 4. The groove 74 has, in this particular embodiment, sides 77, which diverge downwardly, and a flat bottom wall 78 (FIG. 7). The opening 69 in the embossment 67 opens into the groove 74 as shown in FIG. 6. In this particular embodiment, the groove 74 is located rearwardly of the rib 71.

The front wall 52 (FIG. 8) has a pair of elongated openings 81 and 82 therein separated by a central wall 83 having a width comparable to the diameter of the embossment 67. The openings 81 and 82 open outwardly of the front wall 53 and outwardly of the rearwardly facing wall 63 in the recess 61. The surface 84 defining the bottoms of each of the openings 81 and 82 smoothly merges into the plane of the bottom wall 62 of the recess 61. In this particular embodiment, the bottom walls 84 and top walls 86 of each of the openings 81 and 82 diverge frontwardly, as illustrated in FIG. 7.

Figure 8:
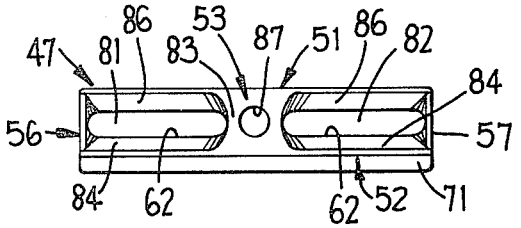
FIG. 8 is a front view of one part of the master carrier.
Figure 9:
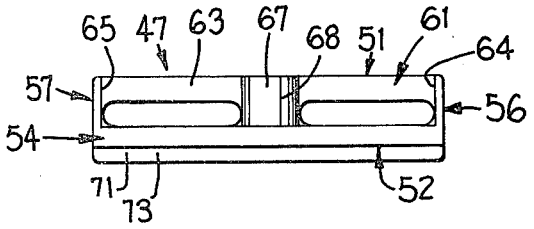
FIG. 9 is a rear view of the aforesaid one part of the master carrier.

The central wall 83 has a frontwardly opening, blind hole 87 therein as illustrated in FIGS. 6 and 8. The purpose of this blind hole and the shape of the remainder of the master carrier slide are to maintain a generally uniform wall thickness throughout for the thermoplastic material to enable the material to cure evenly following an injection thereof into a mold.

The master carrier bridge 48 (FIG. 4) is also made of a thermoplastic material and has a generally uniform wall thickness throughout. More specifically, the master carrier bridge 48 has a generally U-shape with upstanding front and rear legs 88 and 89, respectively, and an interconnecting bight 91. The upstanding leg 89 has a top wall 93, a rearwardly facing wall 95 and a frontwardly facing wall 97. The upstanding leg 89 has a rectangular vertical and central hole 92 opening through the top wall 93, as shown in FIG. 4. A pair of openings 94 and 96 extend horizontally completely through the leg 89 and are located on laterally opposite sides of the central hole 92. The openings 94 and 96 open through the front and rear walls 97 and 95, respectively, of the leg 89. The top wall 93 has a pair of openings 98 and 99 on opposite sides of the central opening 92 which open into the openings 94 and 96, respectively. The top wall 93 of the leg 89 is flat and has a pair of beveled edges 101 and 102 which are preferably inclined to the vertical at the same angle as the side walls 77 of the groove 74 in the master carrier slide 47. In addition, the vertical height of the edges 101 and 102 is equal to the vertical height of the side walls 77.

An upwardly and rearwardly opening slot 103 (FIG. 6) is provided in a central location in the bottom side of the leg 89 and opens upwardly into the central hole 92. The purpose of this slot will be discussed below. In this particular embodiment, the slot 103 has edge walls that are inclined to the horizontal at approximately a 30° angle as illustrated in FIGS. 6 and 7. The opposite end walls 104 of the leg 89 are angled at the bottom edge 105 thereof also at approximately 30° parallel to and in generally the same plane as the uppermost wall of the slot 103.

The leg 88 of the master carrier bridge 48 is actually composed of two horizontally spaced leg members 106 and 107, which are integral with the bight 91 and have lower portions inclined to the vertical at approximately 45°. The upper portions of the elements 106 and 107 comprise L-shaped supports 108 and 109, respectively. Each of the L-shaped supports 108 and 109 has an upright flange 111 and a frontwardly extending, horizontal flange 112. In addition each leg 106 and 107 is reinforced by an integral brace 113 which is also integral with the bight 91 and the rear surface of the flanges 111.

The master carrier bridge 48 is secured to the master carrier slide 47 by a screw 114 which is received through either the hole 98, when it is aligned with the hole 69, or the hole 99 when it is aligned with the hole 69. In the particular embodiment shown in FIGS. 2 and 6, the hole 99 is aligned with the hole 69 to operate with the left half of a two part drapery or blind.

Figure 2:
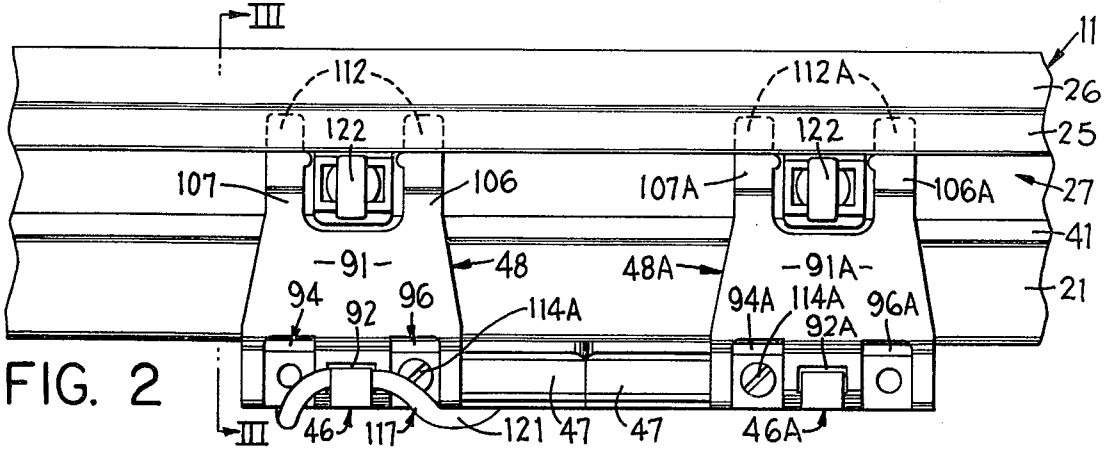
FIG. 2 is a bottom view of a fragment of the traverse rod with master carriers thereon.

The master carriers 46 and 46A are simple to assemble upon the traverse rod 11. More specifically, the master carrier slide 47 can be first slid into the channel 24 so that the wall 17 is received in the slot 58 (FIG. 3) and the surface 73 on the rib 71 slides on the inner wall surface of the rear wall segment 22. Once in this position, the downwardly opening groove 74 is located entirely outside and rearwardly of the traverse rod 11. Thereafter, the master carrier bridge 48 is maneuvered so that the L-shaped support members 108 and 109 enter the channel 28 of the traverse rod 11 through the opening 27. The horizontal flange 112 of each of the L-shaped support members 108 and 109 rests in the free edge of the inclined bottom wall portion 25 of the channel 28. The bight 91 extends below the traverse rod 11, as illustrated in FIGS. 2 and 3. The hole 99, as aforesaid, is axially aligned with the hole 69 in the master carrier slide and, thereafter, the screw 14 is inserted to effectively secure the master carrier bridge 48 to the master carrier slide 47. The top wall 93 (FIG. 4) of the leg 89 on the bridge 48 will engage the bottom wall 78 of the groove 74. In addition, the side walls 77 will snugly engage the edge walls 101 and 102.

The spacing 116 between the legs 106 and 107 on the master carrier bridge 48 is adapted to receive and closely confine a standard drapery or blind hanger 122 which is independently slidably supported in the channel 28 of the traverse rod 11. Thus, as the master carriers 46 and 46A are moved along the length of the traverse rod, a leading one of the hangers 122 will be caused to move therewith thereby effecting a movement of the drapery material or vertical blinds therewith.

Cordage 117 (FIGS. 1 and 3) is secured to each of the master carriers 46 and 46A. It is preferred that a single strand of cordage 117 be utilized in this securement. The cordage extends around pulleys, not shown, in the end structures 12 and 13, which pulleys are described in detail in copending application Ser. No. 298,554 with the opposite ends of the cordage being brought respectively through the openings 81 and 82 in the master carrier slide 47 to a point externally of the traverse rod 11. A particular section 121 of the cordage 117 is also laced first from the inside of the channel 24 out through the opening 82 in the master carrier slide 46 (FIG. 1) and in through the opening 81 prior to its being laced out through the opening 82 in the master carrier 46A. Knots 118 and 119 (FIG. 1) are then tied into the cordage adjacent the ends to prevent retraction of the cordage through the openings 81 and 82 in the master carrier 46A. The reach 121 can be placed into the slot 103 to effect a securement of the master carrier 46 to the cordage 117. The slot 103 is not utilized in the master carrier 46A due to the securement to the cordage being accomplished by the knots 118 and 119.

In this particular embodiment, the cordage 117 is made of a compressible and flexible cordlike material having a diameter slightly greater than the width of the slot 103. As a result, the cordage 117 is compressed during its entry into the slot 103 so that it will be snugly held therein and will not slip with respect to the master carrier.

It will be noted in FIG. 2 that the master carrier slides 47 abut each other when the two parts of the drapery material are in their closed positions across the window opening. The spacing between the hangers 122 straddled by the legs 106 and 107A of the master carrier bridges 48 and 48A is about the same distance between the other adjacent hangers slidably supported on the traverse rod 11.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In combination, a horizontally elongated drapery rod having wall means defining first and second side-by-side parallel channels extending lengthwise of said rod, said wall means also defining first and second elongated slots extending lengthwise of said rod and respectively communicating with said first and second channels, said first channel being disposed adjacent the front side of said rod and said first slot opening downwardly from said first channel, a master carrier slidably supported on said rod for movement lengthwise therealong, and elongated flexible propelling means housed within said second channel and extending therealong for connection to said master carrier to effect slidable movement thereof along said rod, the improvement wherein said master carrier comprises:

first and second carrier members which are separate from one another and are slidably supported in said first and second channels, respectively;

said first carrier member having a first part which is slidably supported within said first channel and a second part which is releasably but fixedly connected to said second carrier member, said first carrier member also having a third part which is fixed to said first part and projects downwardly through said first slot and rearwardly of said rod for fixed connection to said second part;

first fastening means for releasably but fixedly coupling the second part of said first carrier member to said second carrier member, said first fastening means including means permitting said first carrier member to be fixedly but releasably attached to said second carrier member at either a first location disposed adjacent one end of said second carrier member or a second location disposed adjacent the other end of said second carrier member so that said master carrier can be used for either right-hand or left-hand operation;

means defining a passageway extending transversely through said first carrier member for permitting said elongated flexible propelling means to extend therethrough; and second fastening means on one of said first and second carrier members for permitting attachment of said propelling means thereto.

2. The combination according to claim 1, wherein said second carrier member is elongated in the lengthwise direction of said rod, said first carrier member having a length in said lengthwise direction which is substantially less than the length of said second carrier member.

3. The combination according to claim 2, wherein said first fastener means includes first and second openings formed in one said carrier member and spaced apart in the lengthwise direction thereof, and third opening means extending through the other said carrier member, said third opening means being aligned with said first and second openings when said first carrier member is in said first and second positions, respectively, with respect to said second carrier member.

4. The combination according to claim 3, wherein said second slot opens rearwardly, said second carrier member having a first part positioned within said second channel and a second part which projects outwardly through said second slot and is positioned rearwardly of said rod, the second part of said first carrier member being releasably but fixedly connected to the second part of said second carrier member.

5. The combination according to claim 2, wherein said second carrier member has outwardly facing end surfaces which extend substantially perpendicularly with respect to the lengthwise direction of said rod, the opposed end surfaces on a pair of said master carriers being adapted to function as stop surfaces and abut one another when said pair of master carriers are used in association with the center edges of right-hand and left-hand drapery or blind panels.

6. A master carrier for use on a horizontally elongated drapery rod having front and rear side-by-side parallel channels, said front and rear channels respectivley having first and second lengthwise extending slots opening outwardly thereof, said first slot as associated with said front channel opening downwardly, and elongated flexible propelling means being housed within the rear channel for connection to the master carrier to control slidable displacement thereof lengthwise of said rod, said master carrier comprising:

a first one-piece carrier member having a front part slidably supported in said front channel, a rear part positioned exteriorly of said rod in the vicinity of said second slot, and a third part which is integral with and extends between said first and second parts, said third part projecting downwardly through said first slot and projecting rearwardly therefrom beneath said rod for connection to said second part;

a second one-piece carrier member separate from said first carrier member and having a first portion slidably supported in said rear channel and a second portion positioned in the vicinity of said second slot, said second portion and said third part having opposed surfaces in abutting engagement with one another;

releasable fastening means for releasably but fixedly connecting said second part of said first carrier member to said second portion of said second carrier member, said releasable fastening means including means permitting said first carrier member to be fixedly but releasably attached to said second carrier member at either a first location disposed adjacent one end of said second carrier member or a second location disposed adjacent the other end of said second carrier member so that said master carrier can be used for either right-hand or left-hand operation; and said second carrier member having passageway means extending transversely therethrough and communicating with said second slot for permittng said elongated flexible propelling means to be coupled to said second carrier member.

7. A master carrier according to claim 6, wherein said second carrier member comprises a blocklike member which is elongated in the lengthwise direction of said rod, said first carrier member having a length in said lengthwise direction which is substantially less than the length of said second carrier member.

8. A master carrier according to claim 7, wherein said second carrier member and said second part of said first carrier member define thereon a lengthwise elongated slot and a lengthwise elongated projection which extends into said slot for snugly interfitting therebetween, said releasable fastener means including first and second openings formed in said second part of said first carrier member and spaced apart in the lengthwise direction thereof, and a third opening formed in said second portion of said second carrier member, said third opening being aligned with said first and second openings when said first carrier member is in said first and second positions, respectively, with respect to said second carrier member.

9. A master carrier according to claim 6, wherein said first carrier member is bifurcated and has a recess which extends inwardly from the front edge thereof in perpendicular relationship to the lengthwise direction of said rod, said recess extending transversely through said first part and downwardly through that portion of said third part which is aligned with said first slot so that said recess opens downwardly through said first slot, whereby said first part defines two sub parts which are spaced apart in the lengthwise direction of the front channel and define said recess therebetween for confining therein a drapery hanger which can be independently slidably supported within said front channel so as to project downwardly through said first slot.

10. A master carrier for use on a horizontally elongated drapery rod having front and rear side-by-side parallel channels, said front and rear channels respectively having first and second lengthwise extending slots opening outwardly thereof, said first slot as associated with said front channel opening downwardly, and elongated flexible propelling means being housed within the rear channel for connection to the master carrier to control slidable displacement thereof lengthwise of said rod, said master carrier comprising:

a first one-piece carrier member having a front part slidably supported in said front channel, a rear part positioned exteriorly of said rod in the vicinity of said second slot, and a third part which is integral with and extends between said first and second parts, said third part projecting downwardly through said first slot and projecting rearwardly therefrom beneath said rod for connection to said second part;

said first carrier member being bifurcated and having a recess which extends inwardly from the front edge thereof in perpendicular relationship to the lengthwise direction of said rod, said recess extending transversely through said first part and downwardly through that portion of said third part which is aligned with said first slot so that said recess opens downwardly through said first slot, whereby said first part defines two sub parts which are spaced apart in the lengthwise direction of the front channel and define said recess therebetween for confining therein a drapery hanger which can be independently slidably supported within said front channel so as to project downwardly through said first slot;

a second one-piece carrier member separate from said first carrier member and having a first portion slidably supported in said rear channel and a second portion positioned in the vicinity of said second slot, said second portion and said third part having opposed surfaces in abutting engagement with one another;

releasable fastening means for releasably but fixedly connecting said second part of said first carrier member to said second portion of said second carrier member; and said second carrier member having passageway means extending transversely therethrough and communicating with said second slot for permitting said elongated flexible propelling means to be coupled to said second carrier member.

11. A master carrier according to claim 10, wherein said second slot opens rearwardly of said rod, the second part of said first carrier member being positioned rearwardly of said rod in the vicinity of said second slot, said third part of said first carrier member comprising a thin platelike part which extends substantially horizontally and projects rearwardly from said first slot to the rear of said rod for connection to said rear part, said platelike part being positioned directly below but in close proximity to the bottom wall of said rod.

12. A master carrier according to claim 11, wherein said second portion of said second carrier is positioned rearwardly of said rod in the vicinity of said second slot and defines a downwardly opening guide groove therein, said second part of said first carrier member being positioned directly below said second portion and defining thereon an upwardly facing guide projection which snugly seats within said guide groove, and said removable fastener means including a threaded fastener for directly connecting said second portion and said second part together.

13. In combination, a horizontally elongated drapery rod having wall means defining first and second side-by-side parallel channels extending lengthwise of said rod, said wall means also defining first and second elongated slots extending lengthwise of said rod and respectively communicating with said first and second channels, said first channel being disposed adjacent the front side of said rod and said first slot opening downwardly from said first channel, a master carrier slidably supported on said rod for movement lengthwise therealong, and elongated flexible propelling means housed within said second channel and extending therealong for connection to said master carrier to effect slidable movement thereof along said rod, the improvement comprising:

said wall means defining said rod including front and rear walls extending between top and bottom walls, said wall means including an intermediate vertical wall which is spaced between said front and rear walls so as to separate and isolate said first and second channels from one another, said rear wall defining therein said second slot, said bottom wall including a first bottom wall portion which projects rearwardly from said front wall to one edge of said first slot, said bottom wall including a second bottom wall portion which projects rearwardly from the other edge of said first slot to said rear wall, said second bottom wall portion being disposed at an elevation substantially above said first bottom wall portion; and said master carrier including first and second carrier members which are separate from one another and are respectively slidably supported in said first and second channels, said first carrier member having a first part which is slidably supported within said first channel and a second part which is releasably but fixedly connected to said second carrier member, said first carrier member also having a third part which is fixed to said first part and projects downwardly through said first slot and rearwardly of said rod for fixed connection to said second part;

said third part of said first carrier member comprising a thin platelike portion which extends horizontally and is positioned below but in close proximity to said second bottom wall portion, said platelike portion adjacent the forward end thereof having an upwardly projecting leg which extends through said first slot and is fixedly joined to said first part of said first carrier member, said first part of said first carrier member and the adjacent portion of said third part as vertically aligned with said first slot being of a bifurcated construction as defined by two portions which are spaced apart in the lengthwise direction of said rod and define a space therebetween which is aligned with and communicates directly with said first slot for permitting a drapery hanger to be individually and independently slidably supported within said first channel and project downwardly through said first slot while being confined lengthwise between said two portions of said first carrier member;

said first part of said carrier member comprising a substantially L-shaped structure associated with the free end of each of said two portions, said L-shaped structure including a horizontal bottom leg which is positioned within said first channel and is slidably supported directly adjacent said bottom wall and a vertical leg which projects upwardly from said bottom leg into said first channel;

first fastening means for releasably but fixedly coupling the second part of said first carrier member to said second carrier member;

means defining a passageway extending transversely through said first carrier member for permitting said elongated flexible propelling means to extend therethrough; and second fastening means on one of said first and second carrier members for permitting attachment of said propelling means thereto.

14. In combination, a horizontally elongated drapery rod having wall means defining first and second side-by-side parallel channels extending lengthwise of said rod, said wall means also defining first and second elongated slots extending lengthwise of said rod and respectively communicating with said first and second channels, said first channel being disposed adjacent the front side of said rod and said first slot opening downwardly from said first channel, a master carrier slidably supported on said rod for movement lengthwise therealong, and elongated flexible propelling means housed within said second channel and extending therealong for connection to said master carrier to effect slidable movement thereof along said rod, the improvement wherein said master carrier comprises:

first and second carrier members which are separate from one another and are slidably supported in said first and second channels, respectively;

said first carrier member having a first part which is slidably supported within said first channel and a second part which is releasably but fixedly connected to said second carrier member, said first carrier member also having a third part which is fixed to said first part and projects downwardly through said first slot and rearwardly of said rod for fixed connection to said second part;

said first carrier member being, at the front end thereof, of a bifurcated construction and includes a pair of leg portions which are spaced apart in the lengthwise direction of said rod and are separated by a recess which extends vertically through said first part and through the forward end of said third part, said recess extending vertically downwardly from said first channel through said first slot, said leg portions defining a pair of opposed walls which also define the opposite lengthwise-spaced sides of said recess, whereby a drapery hanger can be individually and independently slidably supported on said rod within said first channel and project downwardly through said first slot while being lengthwise confined between said opposed walls;

first fastening means for releasably but fixedly coupling the second part of said first carrier member to said second carrier member;

means defining a passageway extending transversely through said first carrier member for permitting said elongated flexible propelling means to extend therethrough; and second fastening means on one of said first and second carrier members for permitting attachment of said propelling means thereto.

* * * * *

UNITED STATES PATENT AND TRADEMARK OFFICE

CERTIFICATE OF CORRECTION

PATENT NO. : 4,438,798

DATED : March 27, 1984

INVENTOR(S) : James A. FORD et al

It is certified that error appears in the above-identified patent and that said Letters Patent is hereby corrected as shown below:

Column 7, line 39; change "first" to ---second---.

Column 7, line 58; change "positions" to ---locations---.

Column 8, line 20; change "front" to ---first---.

Column 8, line 21; change "rear" to ---second---.

Column 8, line 33; change "third part" to ---second part---.

Column 9, lines 2-3; change "positions" to ---locations---.

Column 9, line 29; change "front" to ---first---.

Column 9, line 30; change "rear" to ---second---.

Column 9, line 57; change "third" to ---second---.

Column 10, line 8; change "rear part" to ---second part---.

Column 11, line 14; before "carrier" insert ---first---.

Column 11, line 26; change "first" to ---second---.

Column 12, line 17; change "includes" to ---including---.

Column 12, line 35; change "first" to ---second---.

Signed and Sealed this

*Twenty-first* Day of *August 1984*

[SEAL]

*Attest:*

GERALD J. MOSSINGHOFF

*Attesting Officer*

*Commissioner of Patents and Trademarks*